US010960563B2

(12) United States Patent
Brellis et al.

(10) Patent No.: US 10,960,563 B2
(45) Date of Patent: Mar. 30, 2021

(54) RAZOR HANDLE

(71) Applicant: BIC-VIOLEX SA, Anixi (GR)

(72) Inventors: Christoforos-Athanasios Brellis, Neapoli (GR); Efstratios Christofidellis, Kifisia (GR); Argyro Kallivretaki, Kolonos (GR); Maria Petratou, Marousi (GR); Ioannis-Marios Psimadas, Vrilisia (GR); Dimitrios Nathanail, Athens (GR)

(73) Assignee: BIC-VIOLEX SA, Anoixi (GR)

( * ) Notice: Subject to any disclaimer, the term of this patent is extended or adjusted under 35 U.S.C. 154(b) by 0 days.

(21) Appl. No.: 16/604,827

(22) PCT Filed: Apr. 11, 2018

(86) PCT No.: PCT/EP2018/059276
§ 371 (c)(1),
(2) Date: Oct. 11, 2019

(87) PCT Pub. No.: WO2018/189235
PCT Pub. Date: Oct. 18, 2018

(65) Prior Publication Data

US 2020/0086516 A1 Mar. 19, 2020

(30) Foreign Application Priority Data

Apr. 13, 2017 (EP) ..... 17166615

(51) Int. Cl.
*B26B 21/52* (2006.01)

(52) U.S. Cl.
CPC ..... *B26B 21/522* (2013.01); *B26B 21/52* (2013.01)

(58) Field of Classification Search
CPC ..... B26B 21/522; B26B 21/00; B26B 21/40; B26B 21/52; B26B 21/528
(Continued)

(56) References Cited

U.S. PATENT DOCUMENTS 2,053,258 A 9/1936 Axien
2,083,172 A 6/1937 Smith
3,823,471 A * 7/1974 Stone ..... B26B 21/06 30/526
(Continued)

FOREIGN PATENT DOCUMENTS

CN 1194606 A 9/1998
CN 101213053 A 7/2008
(Continued)

OTHER PUBLICATIONS

International Search Report and Written Opinion dated Jul. 10, 2018, in International Application No. PCT/EP2018/059276 (8 pages).
(Continued)

*Primary Examiner* — Phong H Nguyen
(74) *Attorney, Agent, or Firm* — Bookoff McAndrews, PLLC

(57) ABSTRACT

A razor handle includes a handle body extending in a longitudinal direction. The handle body includes a first material having a front portion and a rear portion. The razor handle further includes a connecting portion for connection to a razor cartridge. The connecting portion extends from the front portion of the handle body. The handle body includes a supporting element which contributes to a relative movement between the front portion and the rear portion of the handle body.

9 Claims, 7 Drawing Sheets

(58) Field of Classification Search
USPC ..... 30/526, 32
See application file for complete search history.

(56) References Cited

U.S. PATENT DOCUMENTS

| | | | | |
|---|---|---|---|---|
| 4,392,303 | A | 7/1983 | Ciaffone | |
| 4,955,136 | A * | 9/1990 | Diaz-Rivera | B26B 21/10 30/32 |
| 5,771,591 | A | 6/1998 | Armbruster et al. | |
| 7,975,389 | B2 * | 7/2011 | Bozikis | B26B 21/528 30/527 |
| 2004/0177518 | A1 | 9/2004 | Leventhal | |
| 2004/0177519 | A1 * | 9/2004 | Tomassetti | B26B 21/446 30/527 |
| 2009/0293292 | A1 * | 12/2009 | Ramm | B26B 21/528 30/526 |
| 2016/0250765 | A1 * | 9/2016 | Gratsias | B26B 21/522 30/526 |

FOREIGN PATENT DOCUMENTS

| | | | |
|---|---|---|---|
| DE | 202006013187 | U1 | 11/2006 |
| EP | 2459353 | B1 | 3/2014 |
| EP | 2730378 | A2 | 5/2014 |
| EP | 2730378 | B1 | 2/2016 |
| EP | 3388211 | A1 | 10/2018 |
| WO | WO 2006081839 | A1 | 8/2006 |
| WO | WO 2007000185 | A1 | 1/2007 |
| WO | WO 2014022745 | A1 | 2/2014 |
| WO | WO 2018189233 | A1 | 10/2018 |

OTHER PUBLICATIONS

First Office Action and Search Report in corresponding Chinese Patent Application No. 201880012563.9, dated Nov. 2, 2020, English translations (9 pages).

* cited by examiner

RAZOR HANDLE

CROSS REFERENCE TO RELATED APPLICATIONS

This application is a National Stage application of International Application No. PCT/EP2018/059276, filed on Apr. 11, 2018, now published as WO 2018/189235 and which claims priority to European Application No. 17166615.9, filed Apr. 13, 2017.

BACKGROUND

Field

The disclosure relates to razor handles for shaving razors, the razor handles include an elastic part, and shaving razors comprising such razor handles.

Description of Related Art

A razor handle commonly includes an elongated handle body having a rear portion and a front portion. The handle body also includes a connecting portion, extending from the front portion, for connecting to a razor cartridge. Usually, the cartridge, when attached to the razor handle, pivots upward and downward and ensures a constant contact between the cartridge and the surface to shave. In order to improve the shaving experience, the razor handle typically includes a flexible feature. Traditional flexible features allow the razor handle to move from a top of the razor handle nearest the cartridge to a bottom of the razor handle. This type of flexibility in a razor handle does not allow for a safer and more comfortable shaving experience because the full range of flexibility in the razor handle decreases precision of the shave.

For instance, WO2006081839 discloses a razor handle having a rigid core and a layer of compressible elastomeric material, the layer of compressible elastomeric material defining an outer surface of the razor handle, the outer surface defining a finger rest area. Such a handle comprises thus a first and a second material, the second material being more elastic than the first and the rear portion comprising the second material.

SUMMARY

According to the disclosure, a shaving razor may include a razor handle having a rear portion of the razor handle that may be capable of movement relative to the remainder of the razor handle to improve the shaving experience. The razor handle of the present description is also easily manufactured, because of its simple conception.

Aspects of the disclosure include a razor handle having a handle body formed from a first material. The handle body includes a front portion and a rear portion. The razor handle further comprises a longitudinal plane formed along the longitudinal direction and a transverse axis perpendicular to the longitudinal plane, the longitudinal plane separating the handle body in a top portion and a bottom portion. The razor handle further includes a connecting portion extending from the front portion of the handle body for connection to a razor cartridge. The rear portion of the handle body may be formed from a second material, the second material being different from the first material. For example, the second material may be more elastic than the first material whereby the rear portion of the handle body is movable with respect to the front portion. Such a configuration improves the shaving experience by adding a degree of freedom to the shaving razor for while shaving. In addition, the rear portion is movable upwardly and downwardly along the transverse axis with respect to the front portion.

In further aspects, one or more of the following features may be incorporated, alone or in combination:

- the flexibility of the rear portion of the razor body may effect the overall projected length of the razor handle by causing a reduction in the length of the razor handle This may provide a good handling of the razor handle, no matter the size of a hand of the user, thereby allowing the razor handle to be well suited for any user;
- the free end portion may be totally elastic thereby improving ergonomics of the razor handle;
- elastic properties of the second material facilitates movement at the rear portion and/or between the front portion made of the first material and the rear portion made of the second material;
- the rear portion may include a bottom grip.

The bottom grip may facilitate a user being able to grip the razor handle from the back using a finger. The bottom grip may limit a large amplitude of movement of the rear portion relative to the remainder of the handle. A large amplitude of movement is undesirable as it may decrease the general shaving performance. More specifically, a large amplitude of movement prevent close contact between the razor head and the skin, therefore minimizing an efficient shave.

- the length of the rear portion being about 25 mm and 50 mm,
- the rear portion further includes a projecting portion, said projecting portion extending along the rear portion,
- the projecting portion is not entirely visible,
- the handle body has a non-constant width along the longitudinal direction.

BRIEF DESCRIPTION OF THE DRAWINGS

Other characteristics and advantages of the disclosure will readily appear from the following description, provided as non-limitative examples, in reference to the accompanying drawings.

DETAILED DESCRIPTION

Figure 1:
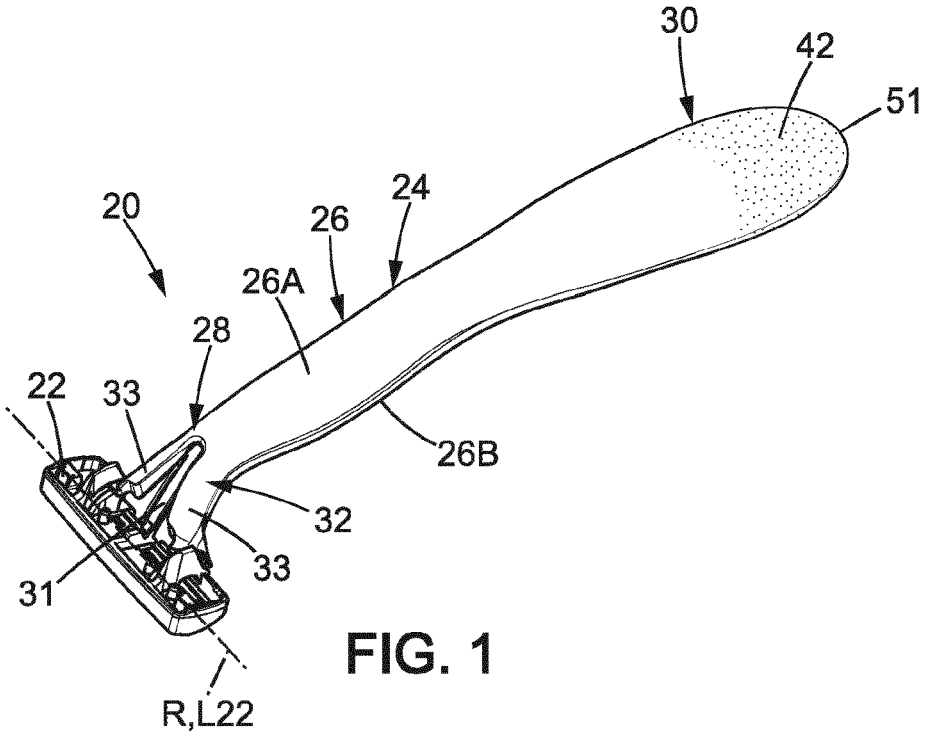
FIG. 1 is a perspective top view of the shaving razor.
Figure 2:
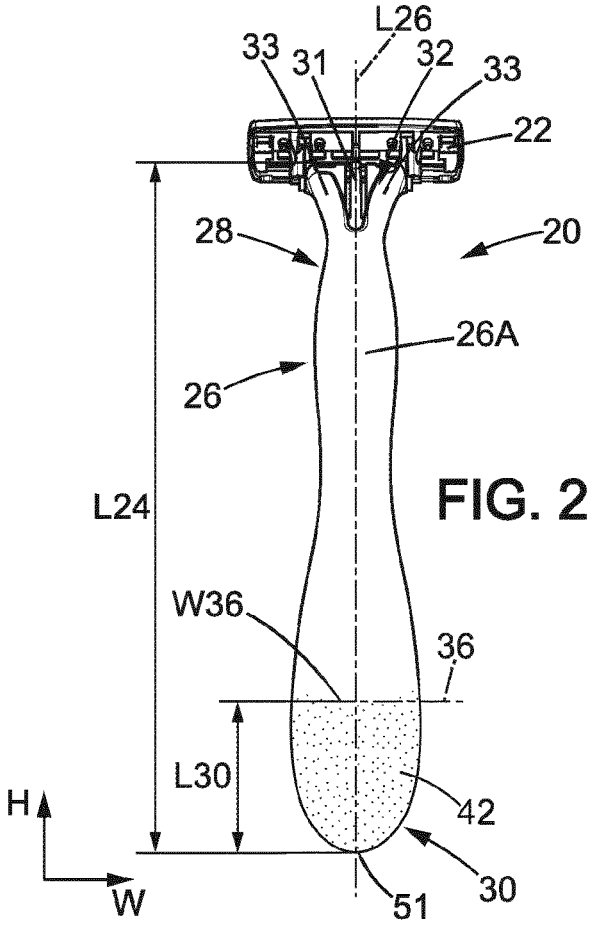
FIG. 2 is a top view of the shaving razor of FIG. 1.
Figure 6:
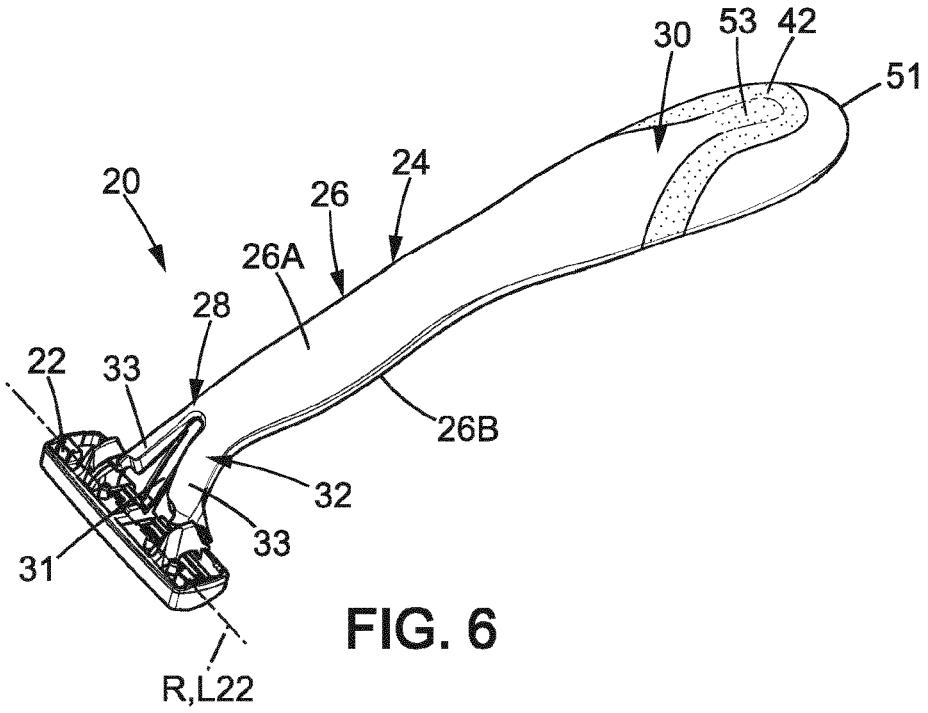
FIG. 6 is a perspective top view of the shaving razor according to a second aspect.
Figure 7:
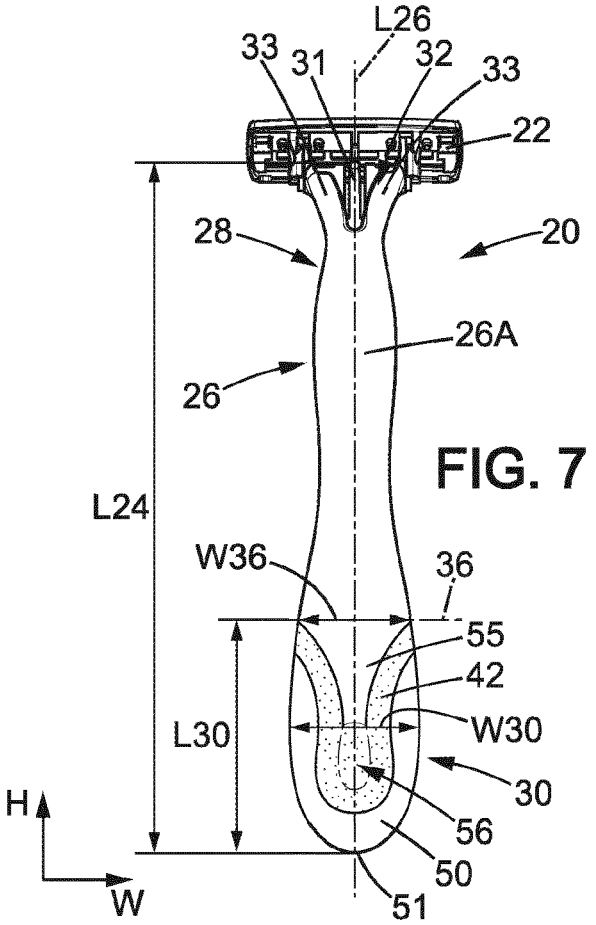
FIG. 7 is a top view of the shaving razor of FIG. 6.

Aspects of the disclosure include a shaving razor 20, as depicted in FIG. 1 or 6, wherein the razor 20 may include a cartridge 22 and a razor handle 24. The cartridge 22 may include blades 21, wherein each blade 21 may include a cutting edge 23. Each cutting edge 23 may extend along a longitudinal direction L22 of the cartridge 22.

The razor handle 24 may include a handle body 26. The handle body 26 may extend along a longitudinal direction L26. More precisely, the handle body 26 may include a front portion 28 and a rear portion 30. The rear portion 30 may include a free end 51. Additionally, the razor handle 24 may include a connecting portion 32, disposed opposite to the rear portion 30.

The connecting portion 32 may extend from the front portion 28, and may be provided to facilitate connection with the cartridge 22. More precisely, in further aspects, the cartridge 22, which extends along the longitudinal direction L22, may be pivotally mounted on the razor handle 24 about a pivot axis R. Thus, the cartridge 22 may pivot with regard to the razor handle 26, as described for example in European patent EP 2 459 353 A1 and of which is incorporated herein by reference in its entirety. The pivot axis R may actually be parallel to the longitudinal direction L22 of the cartridge 22.

The connecting portion 32 may also include two elongated arms 33 extending from the front portion 28, in a direction away from the handle body 26 and a biasing member 31 which may also extend from the handle body 26 in a direction away from the handle body 26 between the two elongated arms 33. The biasing member 31 may be formed as an elastic tongue 31, and may be capable of flexing in a direction perpendicular to a plane defined by the two elongated arms 33. According to further aspects, the biasing member 31 may be a pusher which facilitates release of the cartridge 22 from the razor handle 24. In further aspects, the connection portion 32 may include more than two arms, and/or may incorporate other similarly known designs. In yet further aspects (not shown), the cartridge 22 may be fixedly attached to the connecting portion 32 of the razor handle 24.

Figure 3:
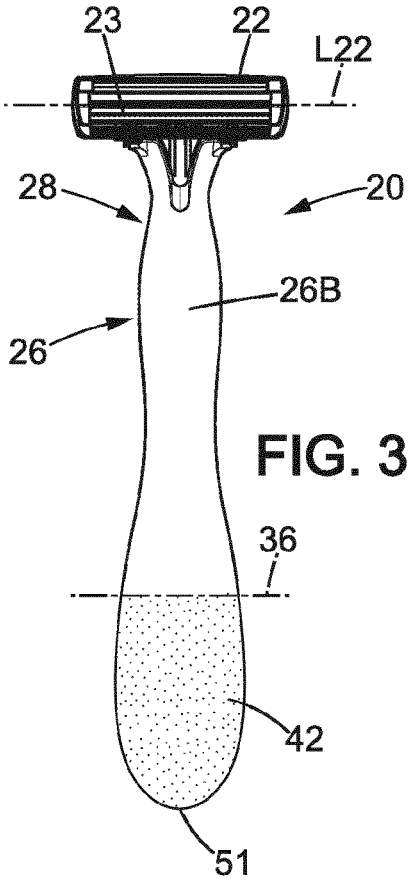
FIG. 3 is a bottom view of the shaving razor of FIG. 1.
Figure 8:
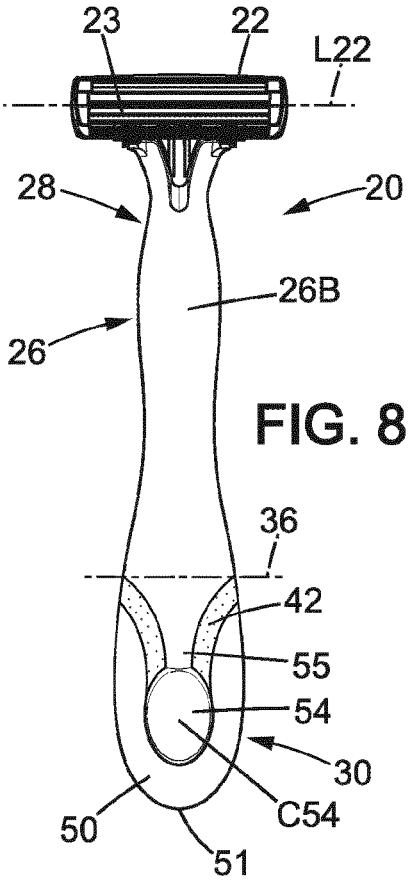
FIG. 8 is a bottom view of the shaving razor of FIG. 6.
Figure 9:
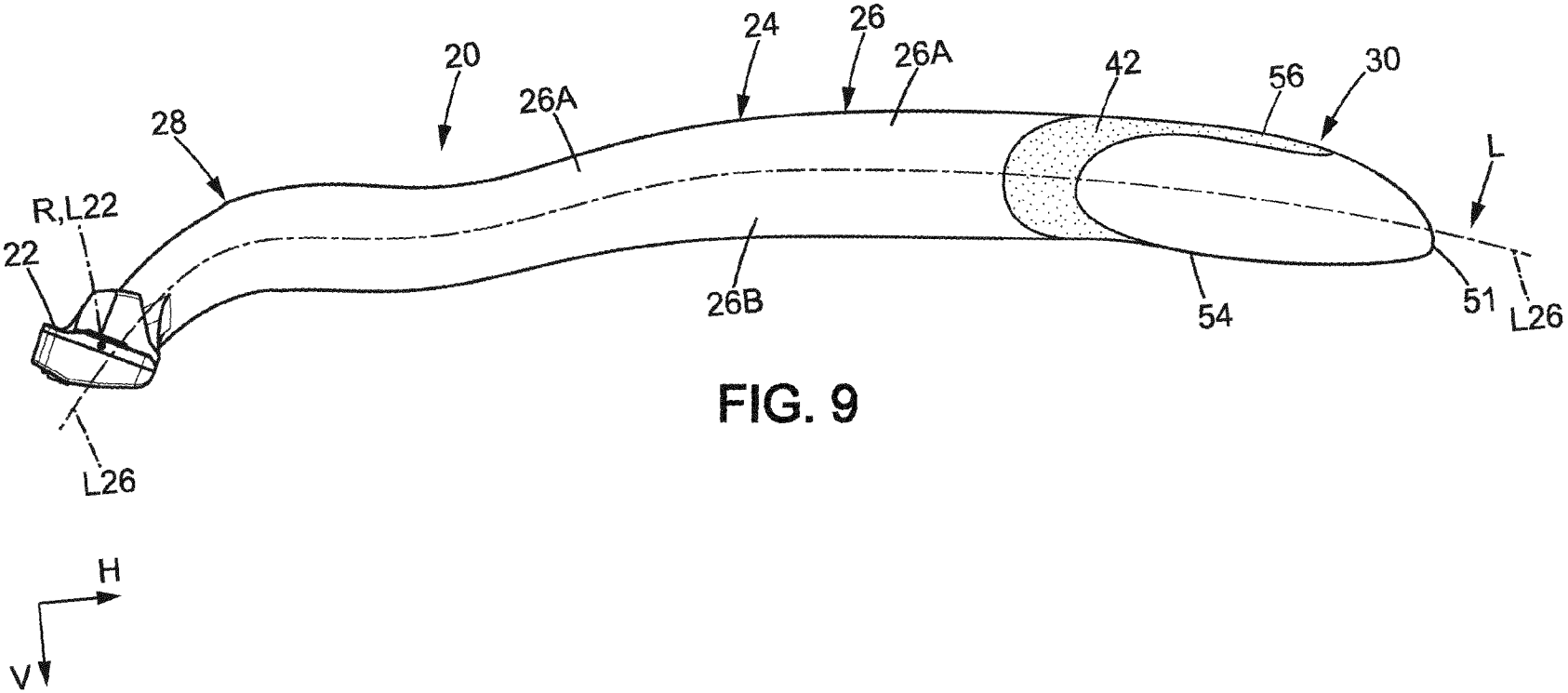
FIG. 9 is a side view of the shaving razor of FIG. 6.
Figure 10C:
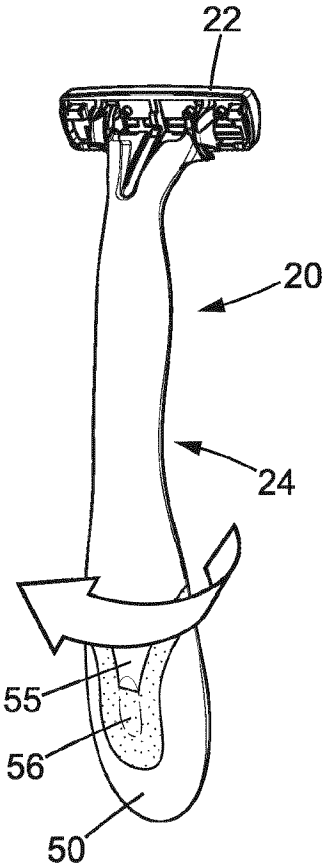
FIGS. 10*a*, 10*b*, 10*c*, 10*d*, 10*e* and 10*f* depicts movement of the rear portion of the handle body of FIG. 6.
Figure 10B:
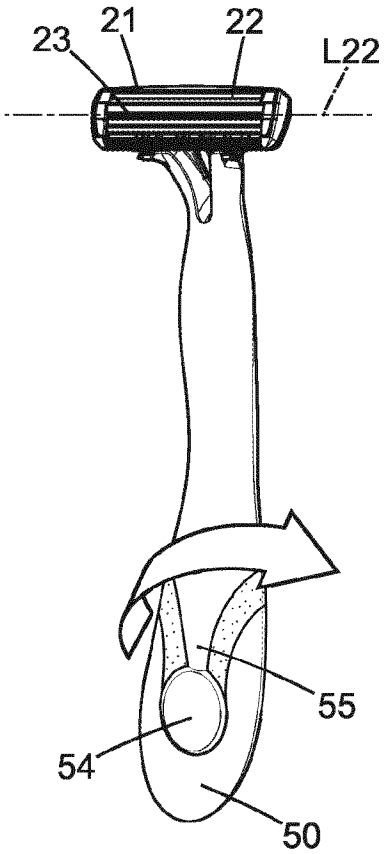
Figure 10A:
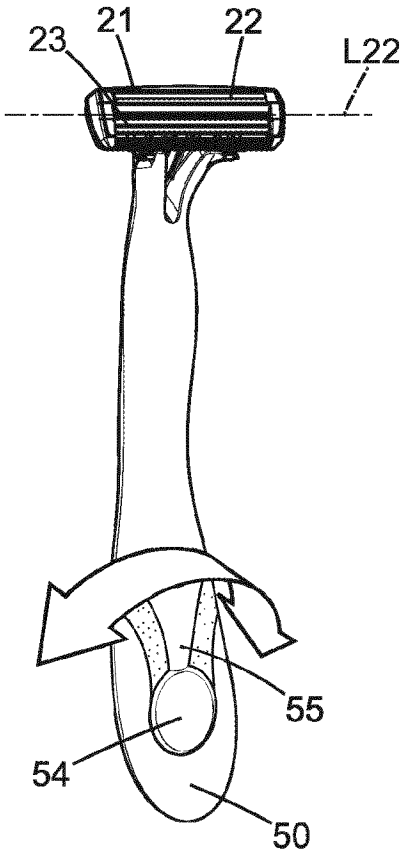
Figure 10D:
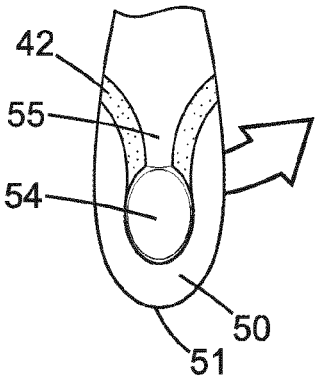
Figure 10E:
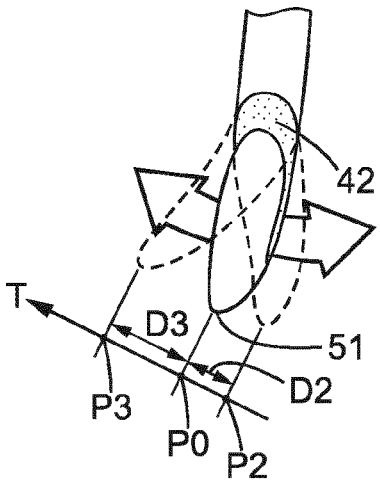
Figure 10F:
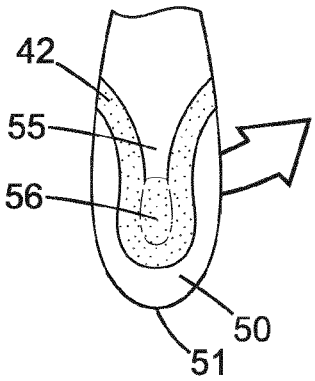

FIGS. 1, 4, 5*a*, 5*b*, 5*c* and 9, depict further aspects of the handle body 26 wherein the handle body 26 may include a top portion 26A and a bottom portion 26B. The top portion 26A and the bottom portion 26B may be separated along a longitudinal plane L, which extends in the longitudinal direction L26 of the handle body 26. Cutting edges 23 of the blades 21 extend on the same side of the the handle body 26 as the bottom portion 26B, as depicted in FIGS. 3 and 8.

According to further aspects, lengths of different portions of the handle body 26 may be defined along the longitudinal direction L26 of the handle body 26, with respect to a horizontal axis H as detailed below:

The length L30 of the rear portion 30 may be between 25 mm and 50 mm. The length L30 of the rear portion 30 may be measured from the rear free end 51 of the razor handle 24 to a boundary line 36. The boundary line 36 may be defined as a line separating the rear portion 30 and the remainder of the handle body 26. For example, the length L30 may 42 mm.

The length L24 of the razor handle 24 may be between 100 mm and 140 mm. The length 24 of the razor handle 24 may be measured from the rear free end 51 of the razor handle 24 to the longitudinal direction L22 of the cartridge 22. For example, the length L24 may be 125 mm.

In yet further aspects, the handle body 26 may not have a constant width along the longitudinal direction L26. For example, the rear portion 30 may have a first width W30. The first width W30 may be measured perpendicularly to the horizontal axis H, along an axis W taken in the longitudinal plane L. The first width W30 may be between 15 mm and 40 mm. For example, the width W30 may be 31 mm. In further aspects, the rear portion 30 of the handle body 26 may include a second width W36. The second width W36 may be measured perpendicularly to the longitudinal plane L along the boundary line 36 of the rear portion 30. The second with W36 may be between 15 mm and 40 mm. For example, the width W36 may be 23 mm. Yet further aspects may include the second width W36 being smaller than the first width W30.

According to further aspects, the handle body 26 may include two materials: a first material and a second material, the second material may be more elastic than the first material. For example, the first material may be made of plastic. In another example, the second material may be rubber. The elastic properties of the second material may provide the user with a grip area, thereby allowing for having a more precise handling of the shaving razor 20 through the flexibility of the handle body 26. In further aspects, the handle body 26 may include an elastic portion 42, which may formed from the second material. The elastic portion 42 may be located at the rear portion 30 of the handle body 26. Consequently, the rear portion 30 may be thus made partly of a first material and partly of a second material. Moreover, the second material may provide suspension thereby acting to absorb the force applied by a user on the elastic portion 42. According to further aspects, the second material may also be perfumed, which increases the wellness and the feeling of an efficient and clean shaving.

In further aspects, the elastic properties of the handle body 26 facilitates movement of the rear portion 30 of the handle body 26. For example, the rear portion 30 of the handle body may be movable between a rest position P0 and an extended position P1, P2 or P3. According to all aspects, from the rest position P0, the rear portion 30 of the handle body 26 may move relative to the remainder of the razor handle 24, until the rear portion 30 has reached an extended position P1, P2 or P3, as seen in FIGS. 5*a*, 5*b*, 5*c* and 10. However, the rear portion 30 of the razor handle 24 may always return to the original rest position P0 when the rear portion 30 is not being subjected to stresses.

According to to further aspects, the entire rear portion 30 is made of an elastic portion 42. The outer shape of the rear portion 30 may follow the overall outer shape of the handle body 26. Hence, the rear portion 30 does not form a growth or other protrusion regarding the general shape of the handle body 26. As such, it may not be possible to identify, from the general shape of the handle body 26, the boundary line 36 of the rear portion 30 of the handle body 26.

Figure 5A:
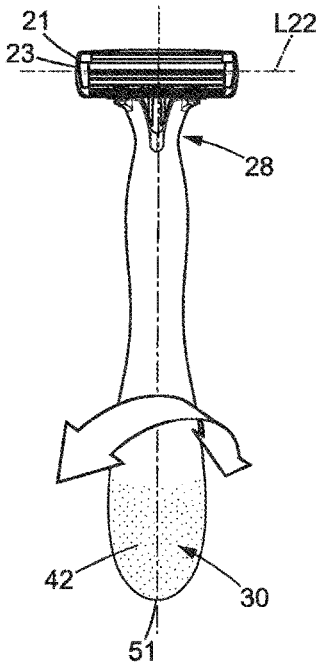
FIGS. 5*a*, 5*b* and 5*c* depicts movement of the rear portion of the handle body of FIG. 1.
Figure 5B:
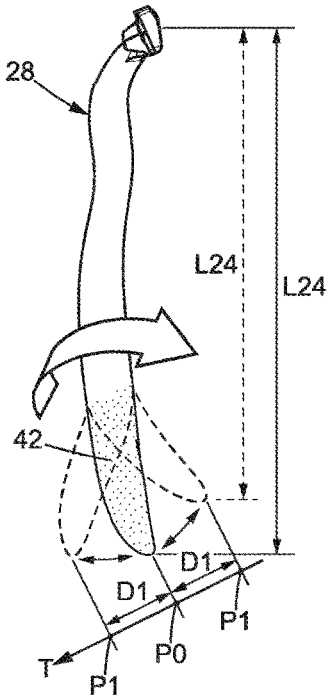
Figure 5C:
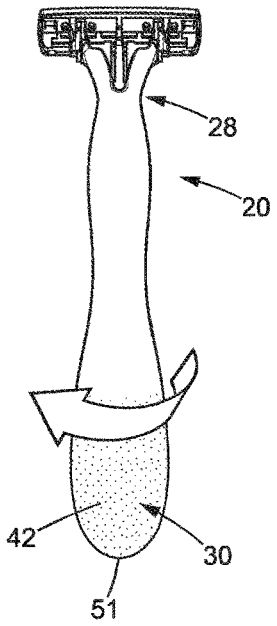

In yet further aspects, FIGS. 5*a*, 5*b* and 5*c* details movement of the rear portion 30 relative to the razor handle 24, and more precisely relative to a transverse axis T. The transverse axis T may pass through the handle body 26 from the top portion 26A to the bottom portion 26B. The transverse axis T is perpendicular to the longitudinal plane L. As such, the rear portion 30 may move upward and downward along to the transverse axis T.

In further aspects, the rear portion 30 may rotate relative to the razor handle. In other words, the rear portion 30 may bend from a rest position P0, upward or downward. Accordingly, the overall length of the razor handle 24 may be reduced, when measured along the horizontal axis H. More precisely, the free end 51 of the rear portion 30 may move with regard to the rest of the razor handle 24 along the transverse axis T from the rest position P0 to an extended position P1, both upwards and downwards. A distance D1 between the extended position P1 and the rest position P0, along the transverse axis T may be between 20 mm and 40 mm. The distance D1 may also be between 25 mm and 28 mm. Additionally, the length L26, when measured along the horizontal axis H, may be reduced from the rest position P0 to the extended position P1. For example, the length L26 may be reduced from 0 mm to 25 mm. The length L26 may also be reduced by 15 mm. In yet further aspects, the elastic portion 42 may twist, along the longitudinal axis L26 of the handle body 26 as shown in FIGS. 5*a*, 5*b* and 5*c*.

Figure 4:
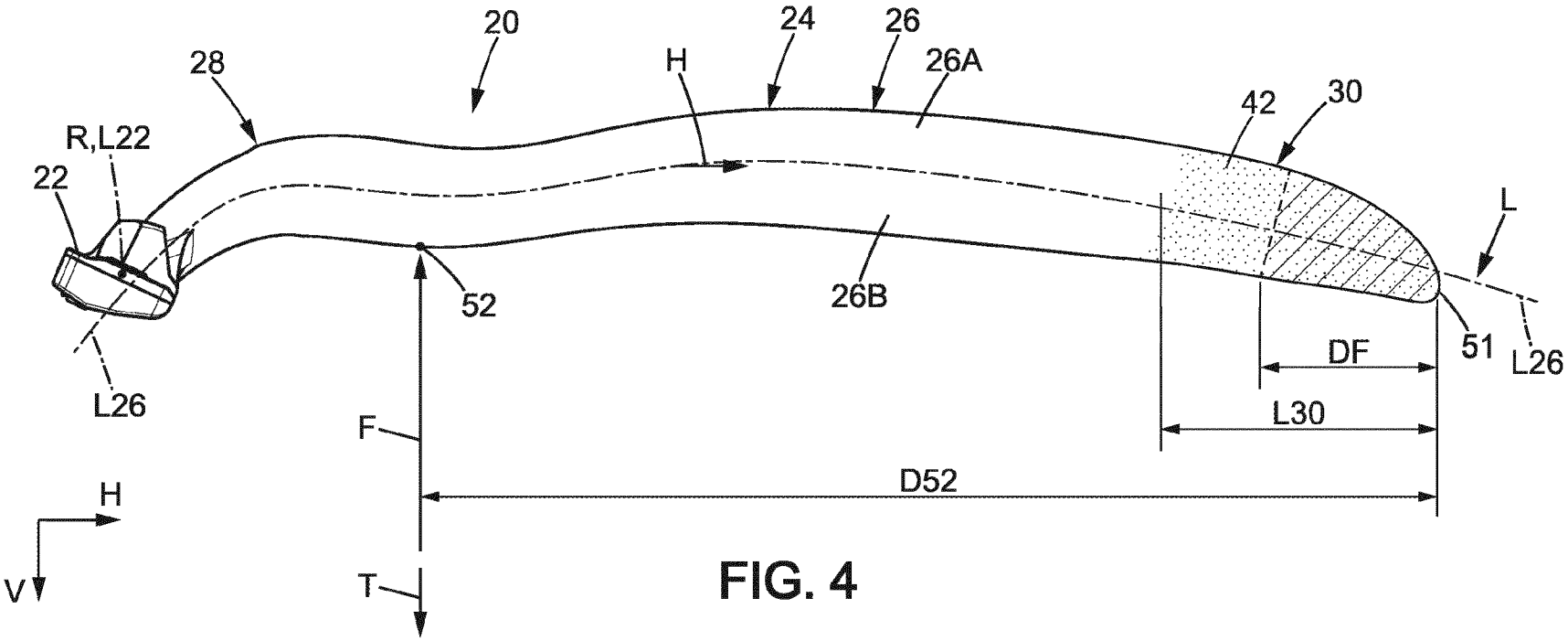
FIG. 4 is a side view of the shaving razor of FIG. 1.

According to further aspects, a sample of second material was chosen to conduct experimental measurements illustrating elasticity of the rear portion 30. FIG. 4 details the experimental measurements wherein approximately half of the rear portion 30 is fixed (represented by an hatched area) while a force F is applied vertically along the transverse axis T at an application point 52. The rear portion 30 may be, for instance, fixed with a clamp to a mount. The distance D52 taken along the horizontal axis H between the free end 51 and the application point 52 may be 100 mm and the length DF of the fixed portion along the horizontal axis H, taken from the bottom 26B of the razor handle 24 may be 21 mm. The following table groups the displacement values along the transverse axis T at the application point 52 of force F obtained as a function of the force F.

| Force (Newton) | displacement (mm) |
|---|---|
| 0 | 1.02 |
| 0.039 | 2.522 |
| 0.055 | 1.479 |
| 0.081 | 4.024 |
| 0.099 | 2.977 |
| 0.13 | 5.528 |
| 0.139 | 4.475 |
| 0.179 | 5.971 |

Values of displacement were obtained with a second material, forming the elastic portion 42, including the following properties:

Tensile strength: 1.3-1.8 MPa

Elongation at break: 100-130 mm

Shore hardness: 39-41 (Scale A)

Tensile tear resistance: 5.0-7.0 Kg/cm

According to further aspects, as shown in FIGS. 6 to 10*f*, the rear portion 30 may include three different parts: a free end portion 50, the elastic portion 42 and a projecting portion 55. The projecting portion 55 may extend along the rear portion 30, and provide better fixation between the elastic portion 42 and the rest of the rear portion 30.

In yet further aspects, as shown in FIG. 8, the free end portion 50 may form an outer outline of the rear portion 30. The projecting portion 55 may protrude from the boundary line 36 of the rear portion 30 and terminate in a recess. The recess may be a bottom grip 54, providing a rest area for a finger of the user. The bottom grip 54 may be located on the bottom portion 26B. Furthermore, the free end portion 50 forms a recess for the bottom grip 54. The center point C54 of the bottom grip 54 is located between 15 mm and 30 mm of the free end 51. For example, the center point C54 is located at 23 mm of the free end 51, with regard to the longitudinal direction L26.

According to further aspects, the projecting portion 55 may not entirely visible, and the bottom grip 54 may only be visible from the bottom 26B. The projecting portion 55 (and thus the bottom grip 54) and the free end portion 50 may be separated from each other by the elastic portion 42. As such, the elastic portion 42 may be located between the free end portion 50 and the projecting portion 55. In other words, the elastic portion 42 may include a material formed and filled in a void of material in the rear portion 30 located between the free end portion 50 and the projecting portion 55, thereby obtaining a general shape of the handle body 26 that does not include a growth or other protrusion. Hence, it may not possible to identify, from the general shape of the handle body 26, the location of the elastic portion 42 disposed within the handle body 26.

In further aspects, the bottom grip 54 may not be formed with respect to the elastic portion 42. Thus, the part of the bottom grip 54 located inwardly of the handle body 26 may not be bonded with the elastic portion 42 and may be free to move.

According to further aspects, the elastical portion 42 may form a top grip portion 56, providing a rest area for a finger of the user. The top grip portion 56 may be located on the top portion 26A.

In further aspects, the bottom grip 54 and the elastic portion 42 may move relative to each other. In other words, the rear portion 30, which contacts the elastic portion 42, may move relative to the bottom grip 54 and the projecting portion 55 (and thus the razor handle 24). More precisely, the free end 51 of the rear portion 30 may move with regard to the remainder of the razor handle 24 along the transverse axis T from the rest position P0 to an extended position P2 upwards and an extended position P3 downwards.

In further aspects, the free end portion 50 may rotate relative to the projecting portion 55. The distance D2 between the extended position P2 and the rest position P0, along the transverse axis T may be between 2 mm and 10 mm. The distance D2 may also be, for example, between 3 mm and 6 mm. The distance D3 between the extended position P3 and the rest position P0, along the transverse axis T may be between 1 mm and 15 mm. The distance D3 may also be, for example, between 3 mm and 5 mm.

According to further aspects, the length L26, when measured along the horizontal axis H, may be reduced from the rest position P0 to the extended positions P2 and P3. For example, the length L26 may be reduced from 0 mm to 10 mm. The length L26 may thus be reduced by 5 mm when in the extended position P2. In another example, the length L26 may thus be reduced by 3 mm when in the extended position P3.

Furthermore, the elastic portion 42 may twist, along the longitudinal axis L26 of the handle body 26 as depicted in FIGS. 10*a*, 10*b*, 10*c*, 10*d*, 10*e* and 10*f*.

The invention claimed is:

1. A razor handle for a shaver comprising:

a handle body including a front portion and a rear portion, the handle body extending along a longitudinal plane between the front portion and the rear portion;

the front portion being formed from a first material and including a connecting portion extending therefrom for connection to a razor cartridge;

the rear portion having a distal-most region, the distal-most region being formed of a second material;

the second material being more elastic than the first material such that only the distal-most region of the rear portion is movable upwardly and downwardly with respect to the front portion along an axis transverse to the longitudinal plane;

wherein the handle body is divided along the longitudinal plane to define a top portion and a bottom portion;

wherein the distal-most region of the rear portion includes a free end and a bottom grip located on the bottom portion, the free end forming a recess for the bottom grip;

wherein the free end and the bottom grip are separated by an elastic portion; and wherein the elastic portion further comprises a top grip on the top portion.

2. The razor handle according to claim 1, wherein the rear portion is capable of rotating around a rotation axis, the rotation axis being perpendicular to the longitudinal plane and the transverse axis.

3. The razor handle according to claim 1, wherein the distal-most region of the rear portion includes a free end, a length of the distal-most region is defined as a distance of between 25 mm and 50 mm from the free end.

4. The razor handle according to claim 1, wherein the rear portion further includes a projecting portion, the projecting portion extending along the rear portion.

5. The razor handle according to claim 1, wherein the handle body further includes a non-constant width along the longitudinal plane.

6. The razor handle according to claim 1, wherein the elastic portion is made of the second material.

7. The razor handle according to claim 1, wherein the free end and the bottom grip are made of the first material.

8. The razor handle according to claim 7, wherein the bottom grip limits a downward movement of the rear portion, in a direction away from the bottom portion.

9. The razor handle according to claim 7, wherein the bottom grip limits an upward movement of the rear portion, in a direction away from the top portion.

* * * * *